United States Patent [19]

Myers, Sr.

[11] Patent Number: 5,011,133

[45] Date of Patent: Apr. 30, 1991

[54] PEDAL DRIVEN SWIVEL TOY

[76] Inventor: Raymond T. Myers, Sr., 2609 So. El Camino Real, San Clemente, Calif. 92672

[21] Appl. No.: 552,771

[22] Filed: Jul. 16, 1990

[51] Int. Cl.[5] ..... A63G 1/28

[52] U.S. Cl. ..... 272/33 B; 272/40

[58] Field of Search ..... 272/33 R, 33 B, 40, 272/41

[56] References Cited

U.S. PATENT DOCUMENTS

| | | | |
|---|---|---|---|
| D. 160,341 | 10/1950 | Reicher . | |
| D. 165,593 | 1/1952 | Low . | |
| D. 208,643 | 9/1967 | Gervais . | |
| 1,643,097 | 9/1927 | Stewart et al. | 272/33 R |
| 2,568,015 | 9/1951 | Low . | |
| 2,920,889 | 1/1960 | Keeling | 272/33 R |
| 3,083,036 | 3/1963 | Cornell, III et al. . | |
| 3,235,252 | 2/1966 | Grant | 272/33 R |
| 3,467,373 | 9/1969 | Justice . | |
| 4,014,540 | 3/1977 | Caulkins . | |
| 4,428,576 | 1/1984 | Fisher, Jr. | 272/33 R |
| 4,431,183 | 2/1984 | Reimann . | |
| 4,896,878 | 1/1990 | Greenwood | 272/40 X |

OTHER PUBLICATIONS

"New Gym/Dandy Twirler", Dec. 1961, Playthings, Vol. 59, No. 12.

*Primary Examiner*—Richard E. Chilcot, Jr.
*Attorney, Agent, or Firm*—Christie, Parker & Hale

[57] ABSTRACT

The pedal driven swivel toy provides a ride for children which includes a combination of translation and rotation. The toy is suspended from a support structure allowing swinging and rotating motion. A wheel contacting the ground and driven by the child through the use of pedals forces the center of gravity of the toy from a stable rest position to an unstable position thereby inducing rotation and swinging of the toy. The combination of motion is exhilarating for the child and the use of pedals provides exercise for the child while allowing control of operation of the toy.

7 Claims, 5 Drawing Sheets

18
20

PEDAL DRIVEN SWIVEL TOY

FIELD OF THE INVENTION

The present invention relates to toys on which a child may ride and which impart swinging motion induced by the child for enjoyment. More particularly, the invention provides a structure to support the child which is suspended to allow swinging and rotating motion. A wheel contacting the ground and driven by the child forces the center of gravity of the structure and seated child from a stable at rest position to an unstable location inducing rotation and swinging of the structure.

BACKGROUND OF THE INVENTION

Play structures have been designed and produced for children which provide swinging and rotating motions to stimulate the child's senses and provide play enjoyment. For economy and to provide exercise for the child, these devices are typically powered by the child. The classic swing is a first example. A seat suspended from a structural support by flexible chains or cables supports the child, the child then creates motion in the swing by flexing the cable with the arms while moving the legs and feet to impart momentum to the swing. Typically, a double cable swing moves as a pendulum in a single plane.

A second example is the teeter totter which provides reciprocating vertical motion for two children. The children operate the device by alternately thrusting upward with their legs while seated moving the teeter totter about its fulcrum point.

Combination swing devices providing seating for two children at opposite ends of a centrally supported bar mounted as a pendulum from a support structure such as that disclosed in U.S. Design Pat. No. 160,341 to Reicher, provide both swinging and vertical motion when powered by one or more children.

The classic merry-go-round provides a rotational motion for the child. This motion has been combined with swinging motion in various devices such as that exemplified in U.S. Pat. No. 4,014,540 to Cauklins. A second device providing both swinging and rotational motion is disclosed in U.S. Pat. No. 4,431,183 to Reimann. In both these devices, swinging motion may be imparted to the structure supporting the child by imparting momentum to the device through motion of the child's arms and legs. Rotational motion may also be imparted by altering momentum through shifting of the child's center of gravity on the device.

The devices described do not provide an easy means to impart motion to the toy. Further, the shifting of the child's center of gravity to create various motions desired may result in the child becoming dislodged from the toy during the ensuing motion.

It is therefore desireable to have a toy which will provide swinging and rotational motion to excite the child but provide an easy means for propelling the device while allowing the child to remain securely seated.

SUMMARY OF THE INVENTION

The present invention comprises a moving angled member which includes a seat or other support means for the child. The angled member is suspended from a structure such as a frame using a universal joint or other means to provide degrees of freedom for rotational and swinging motion of the angled member. A rotating member is attached to the opposite extremity of the angle member from the suspension point and frictionally engages a horizontal surface, typically the ground or a floor, under the device. Means is provided for inducing rotational motion to the rotating member by the child.

In a rest position with the child seated, the center of gravity of the entire device is located in a stable position with respect to a vertical axis through the suspension point. Due to the shape of the angle member, which is longer than the height of the suspension point from the horizontal surface and which traverses the vertical axis, the rotating member is displaced from this axis. When the child imparts rotational motion to the rotating member, the frictional engagement with the horizontal surface causes the angle member to translate from the at rest position to a position with the center of gravity displaced from the axis. This creates an unstable condition which causes the angle member to rotate about the axis. Releasing the force on the rotating member will also allow the angle member to translate or swing along the plane of the angled member.

The child may impart additional rotational motion to the rotational member after the angle member has returned to equilibrium or at any time prior to reaching equilibrium to maintain the toy in motion. Rapid translation and rotation of the angle member on which the child is seated provides an exhilarating ride for the child due to the instability and consequent unpredictability of the motion which is imparted after the child drives the center of gravity from the equilibrium point.

DESCRIPTION OF THE DRAWINGS

The present invention will be more clearly understood from the following detailed description and accompanying drawings wherein.

DETAILED DESCRIPTION

Figure 1:
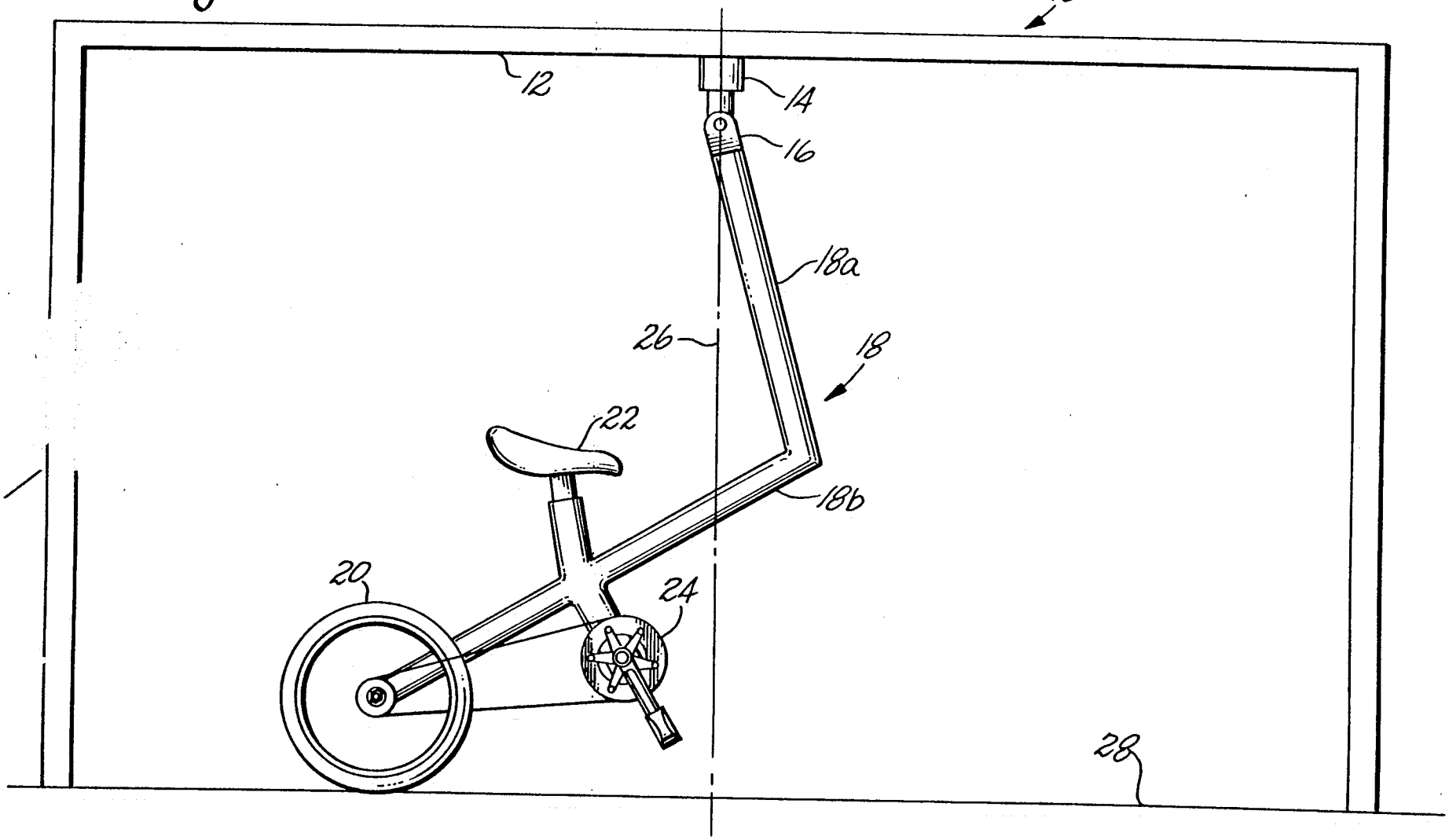
FIG. 1 is a schematic elevational view of the invention.
Figure 2:
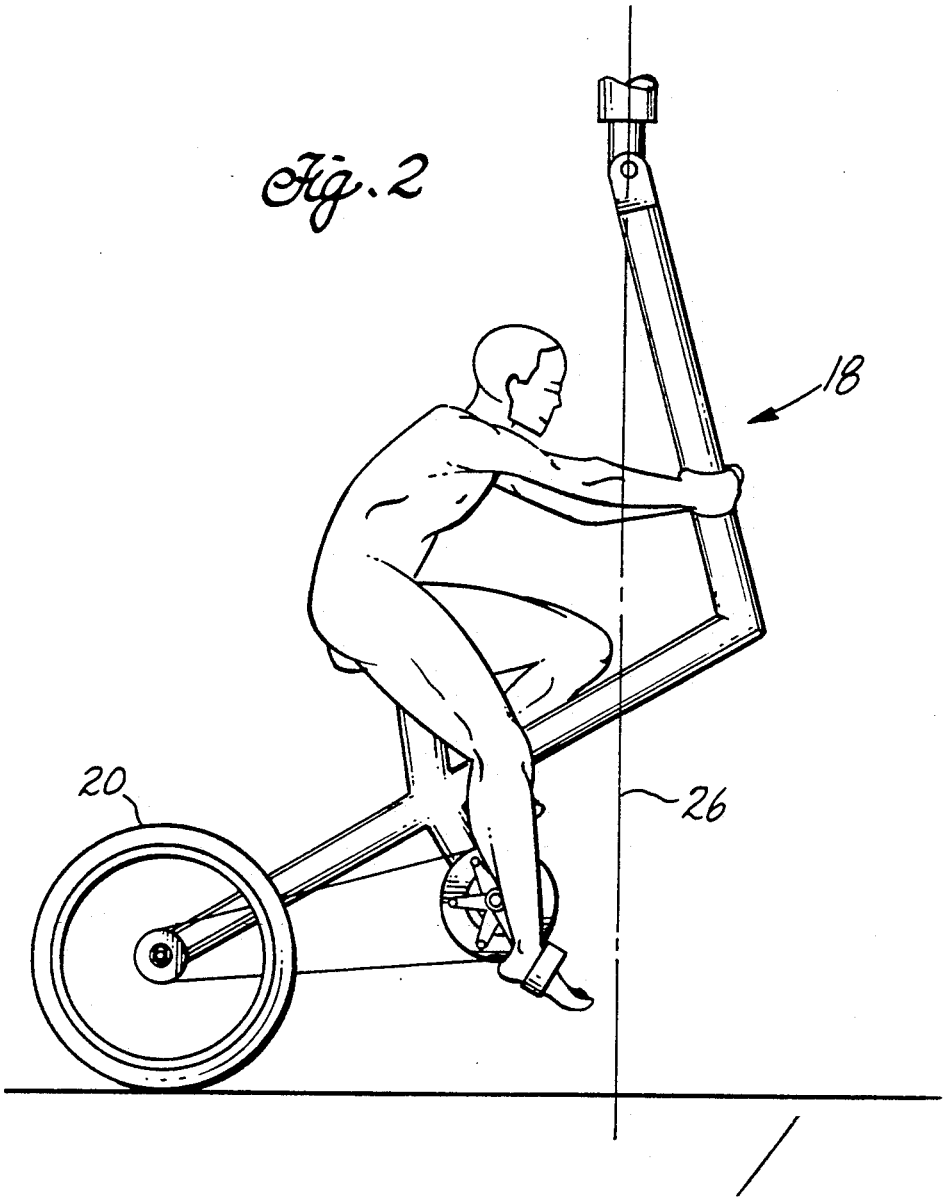
FIG. 2 pictorial view showing the toy in equilibrium.

Referring now to FIG. 1, a first embodiment of the invention is shown suspended from a frame 10 which may be similar to the frame on a conventional swing set or jungle jim. The frame includes a horizontal cross member 12 which provides an attachment point 14 for a swiveling universal joint 16. An angle member 18 which is the primary structure of the toy is attached to the universal joint. A rotating member shown in this embodiment as a wheel 20 is attached to the extremity of the angle member opposite the universal joint attachment. A seat 22 is attached to the angle member to support the child. A drive means shown in the embodiment in the drawings as a pedal set driving a sprocket and chain is attached to the angle member for manipulation by the child to supply rotational power to the wheel. With the child seated and the invention in the equilibrium position as shown in FIG. 2, a vertical axis extends from the attachment point downward to create an axis of rotation.

Figure 3:
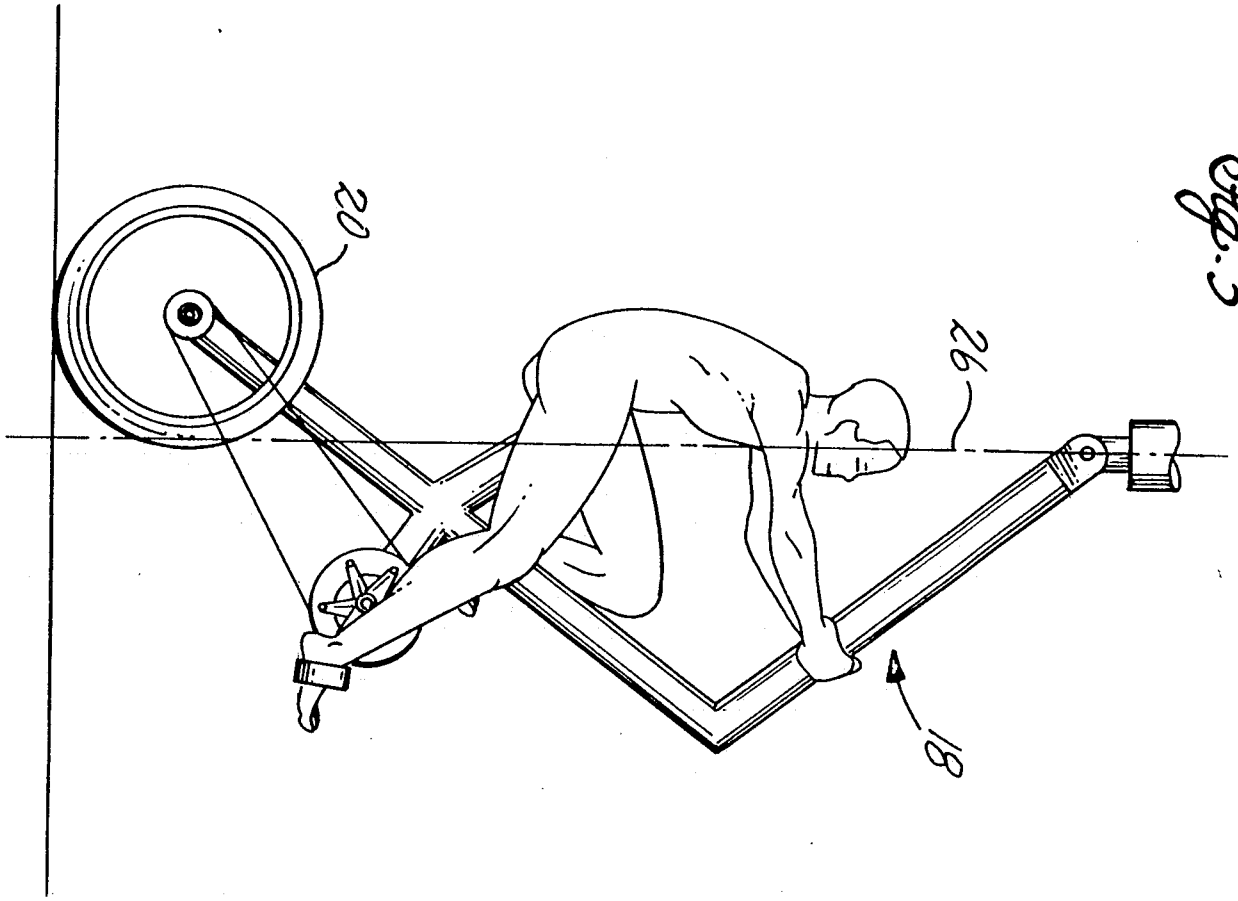
FIG. 3 is a pictorial view showing the toy driven to the off position by the child.

The configuration of the angle member results in the wheel being displaced from the axis. The weight of the child in the device causes the wheel to frictionally engage the ground 28. When the child manipulates the pedals, the rotational motion is imparted to the wheel which drives the angle member in a plane formed by the portions of the angle member 18*a* and 18*b*. The wheel itself is driven towards the axis as shown in FIG. 3. The center of gravity of the device is displaced from the axis until an instability is reached which causes the angle member to rotate about the swiveling universal joint.

Figure 4:
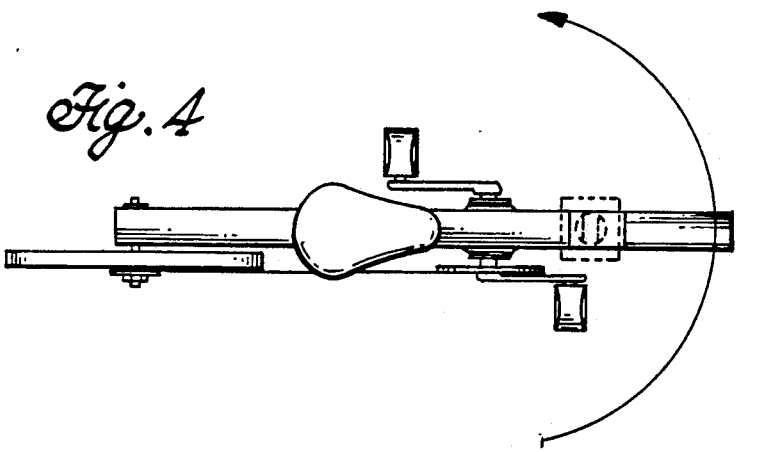
FIG. 4 is a top view of the toy in the off equilibrium position demonstrating the rotational motion potential, and, FIGS. 5*a* and 5*b* show alternate embodiments of the angle member of the invention.

Rotational motion may occur clockwise or counterclockwise as shown in FIG. 4. As the angle member rotates, the wheel rotates about a point on the ground until the momentum created in the device begins the rotation of the wheel in a coaster fashion. Those skilled in the art will recognize that a standard ratcheting coaster arrangement in the sprocket attachment for the chain on the wheel will accommodate this motion. Alternately, the child may remove his feet from the pedals to allow free rotation of the wheel. Without further manipulation of the drive means for the wheel, the angle member will continue to rotate and translate until frictional forces again bring the invention to equilibrium on the axis. Alternatively, the child may at any time again begin manipulation of the pedals providing further rotational force to the wheel driving the device to a new instability point at which renewed rotational and translational motion will begin.

Figure 5B:
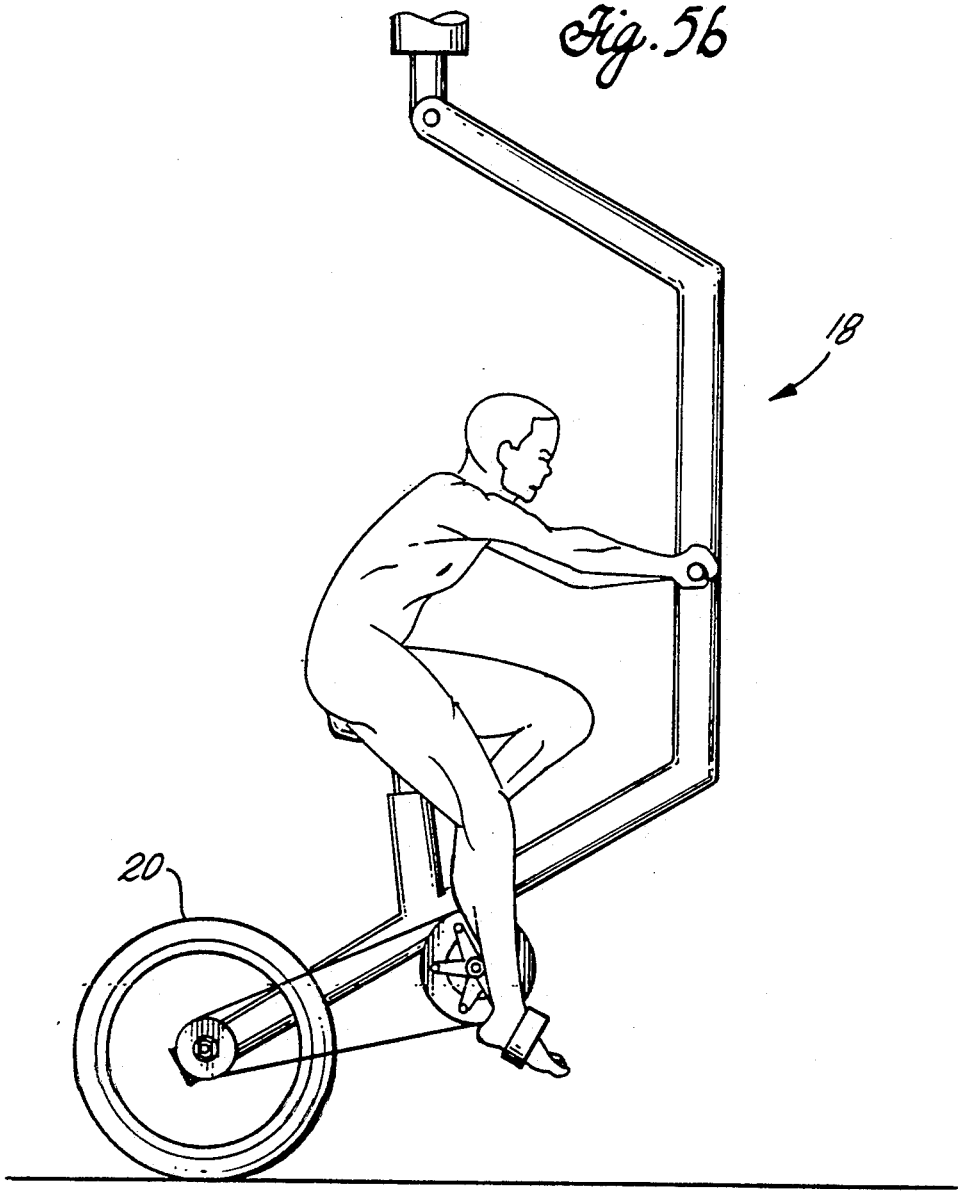
Figure 5A:
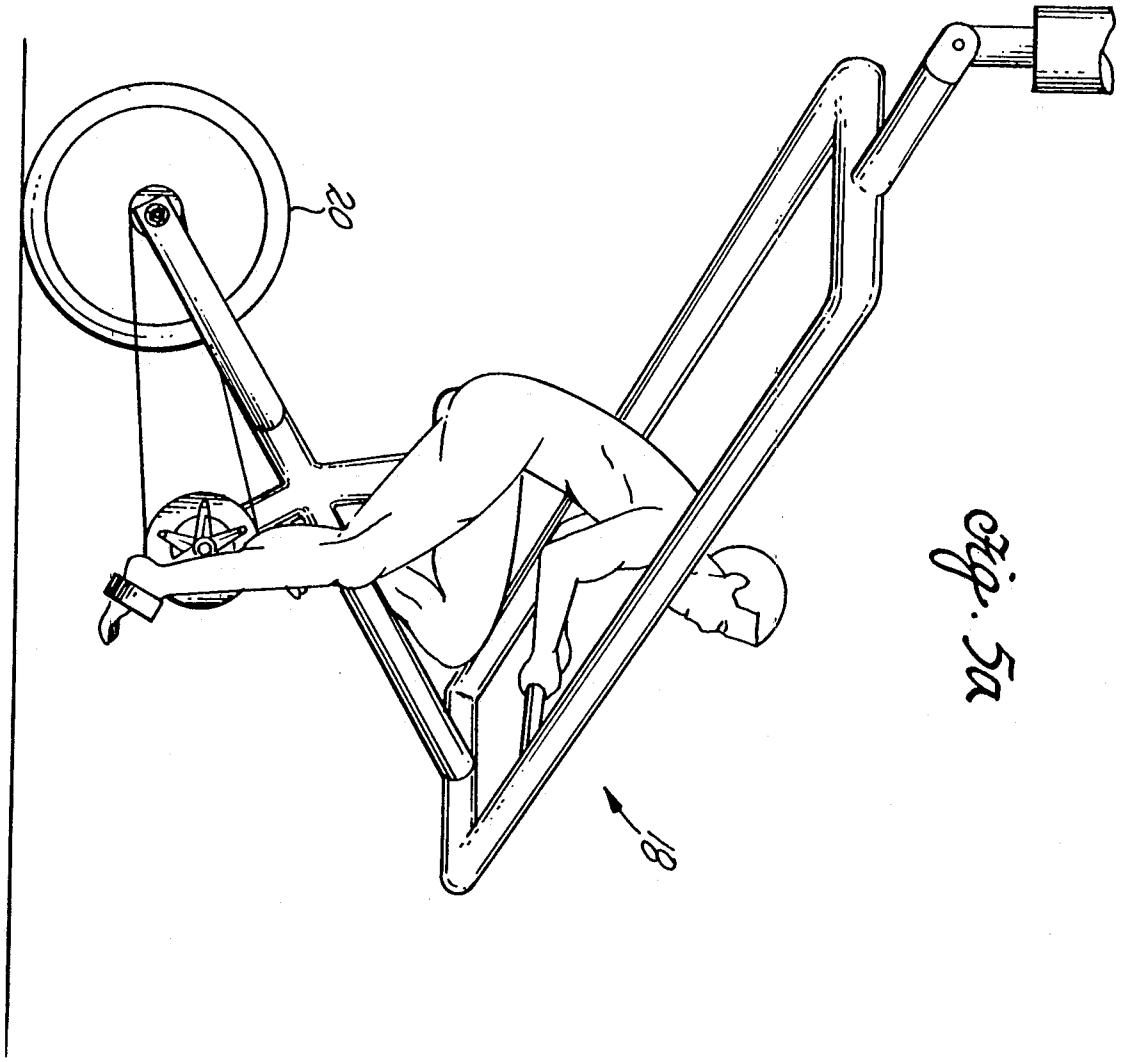

The length of the portions 18*a* and 18*b* of the angle member and the angle subtended are determined by the height of the support point. The first portion of the angle member 18*a* extends downwardly and outwardly from the vertical axis. The second portion of the angle member 18*b* extends from the first portion and traverses through the vertical axis to an end which supports the wheel. The angle member may be a single bar as shown in FIGS. 1 through 4 where sufficient height is available to allow the child to sit erect. Alternatively, a double bar arrangement may be used to allow the child's head and upper torso to extend through the bars as shown in FIG. 5*a*. As a second alternative, the use of multiple angles in the angle member to provide sufficient vertical extent proximate the seat to allow the child to sit upright may be used as shown in FIG. 5*b*. Lateral displacement of the seat from the rotational axis of the wheel with sufficient overall length to allow the wheel to remain in contact with the ground during significant displacement of the seat from the equilibrium axis will be sufficient for operation of the invention.

The invention may be mounted outdoors from a swing set frame as shown in the embodiments of the drawings or an alternate mounting point may be in an appropriate structural member of a ceiling in a room with sufficient height to accommodate the invention. The child may be seated facing either direction with appropriate arrangement of the seat, drive means and hand holds. Additionally, the drive means may incorporate hand operated levers in place of or supplemental to the pedal drive means.

Having now described the invention in detail as required by the patent statutes, those skilled in the art will recognize modifications to the embodiments shown including those described which may be accomplished to modify the invention to suit specific needs or locations. Such modifications are within the scope and spirit of the invention as defined in the following claims:

What is claimed is:

1. A toy suspended from a support structure over a horizontal surface, the toy comprising:

attachment means having a rotating pivot with two degrees of freedom;

an angle member depending from the attachment point, the angle member having an overall length greater than the height of the support structure from the horizontal surface and traversing a vertical axis extending downward from the attachment point;

a rotational means attached to an end of the angle member distal the attachment means, the rotation member adapted for frictional engagement of the horizontal surface;

drive means for providing rotational force to the rotation means; and, a seat attached to the angle member to support a child proximate the drive means to allow operation of the drive means by the child.

2. An apparatus as defined in claim 1 wherein the rotating means is a wheel.

3. A toy as described in claim 1 wherein the drive means comprises pedals and a first sprocket engaging a chain to drive a second sprocket on the wheel.

4. A toy for providing rotational and translational motion comprising:

a support frame having a horizontal member spaced vertically from a horizontal surface, an attachment means having a swivel and pivot attached to the horizontal member, an angle member having a first portion attached to the attachment means and extending downwardly and outwardly from a vertical axis from the attachment point to the horizontal surface and a second portion extending from the first portion through the vertical axis to an end proximate the horizontal surface;

a wheel mounted to the end of the second portion, the wheel frictionally engaging the horizontal surface;

means for supporting a child attached to the angle means;

drive means for operation by the child to drive the wheel whereby the wheel may be driven toward the vertical axis displacing the center of gravity of the angle member with the supported child from the vertical axis.

5. A toy as described in claim 4 wherein the support means is a seat mounted to the second portion of the angle member.

6. A toy as defined in claim 5 wherein the drive means comprises a pedal and sprocket driving a chain engaging a second sprocket on the wheel.

7. A toy comprising;

a means for pivotal and rotational attachment mounted to a support member vertically displaced from a horizontal surface;

means for supporting a child suspended from the rotational and pivotal attachment means; the child and suspension means having a combined center of gravity;

means for driving the support means to displace the center of gravity from an at rest equilibrium position to an unstable position inducing the support means to rotate and pivot through the attachment means, the drive means frictionally engaging the horizontal surface to induce the center of gravity displacement.

* * * * *